US006012278A

United States Patent [19]

Schermer

[11] Patent Number: 6,012,278

[45] Date of Patent: Jan. 11, 2000

[54] OPEN-END SPINNING ROTOR WITH A COATED FIBER GUIDING SURFACE AND PROCESS FOR ITS MANUFACTURE

[75] Inventor: Josef Schermer, Bergheim, Germany

[73] Assignee: Rieter Ingolstadt Spinnereimaschinenbau AG, Ingolstadt, Germany

[21] Appl. No.: 09/096,317

[22] Filed: Jun. 11, 1998

[30] Foreign Application Priority Data

Jun. 13, 1997 [DE] Germany ..... 197 25 032

[51] Int. Cl.[7] ..... D01H 4/00

[52] U.S. Cl. ..... 57/416; 57/414

[58] Field of Search ..... 57/404, 414, 416

[56] References Cited

U.S. PATENT DOCUMENTS

| | | | |
|---|---|---|---|
| 3,439,487 | 4/1969 | Landwehrkamp et al. | 57/414 |
| 4,193,253 | 3/1980 | Herbert et al. | 57/414 |
| 4,358,922 | 11/1982 | Feldstein . | |
| 4,358,923 | 11/1982 | Feldstein | 57/414 |
| 4,547,407 | 10/1985 | Spencer, Jr. . | |
| 4,662,170 | 5/1987 | Raasch . | |
| 4,866,927 | 9/1989 | Fetzer et al. . | |
| 4,928,477 | 5/1990 | Kalitzki et al. . | |
| 5,006,367 | 4/1991 | Lancsek . | |
| 5,528,799 | 6/1996 | Bach et al. . | |
| 5,642,611 | 7/1997 | Stahlecker . | |

FOREIGN PATENT DOCUMENTS

| | | |
|---|---|---|
| 0724023A1 | 7/1996 | European Pat. Off. . |
| 2920593 | 1/1980 | Germany . |
| 4127639A1 | 5/1992 | Germany . |
| 1389244 | 4/1975 | United Kingdom . |

OTHER PUBLICATIONS

German Patent Office Search Report, Oct. 23, 1997.

United Kingdom Patent Office Search Report, Aug. 24, 1998.

WPI Abstract Accession No. 93–172995 [21] & JP050106125A (KANAI) Apr. 27, 1993.

WPI Abstract Accession No. 93–172994 [21] & JP050106124A (KANAI) Apr. 27, 1993.

*Primary Examiner*—William Stryjewski

*Attorney, Agent, or Firm*—Dority & Manning

[57] ABSTRACT

The present invention relates to a spinning device, e.g. an open-end spinning rotor (1) with a fiber guiding surface which is provided with a nickel-diamond coating (3) consisting of at least one inner bearing layer (30) and an outer working layer (31). The diamond grains (40) imbedded in the inner bearing layer (30), with a size between 3.5 $\mu$m and 5 $\mu$m, are larger than the diamond grains (41) imbedded in the outer working layer (31). The inner bearing layer (30) and working layer (31) are interlaced. In manufacture the fiber guiding surface to be provided with a wear-resistant nickel-diamond coating (3) is subjected to at least two coating procedures, whereby in the first coating procedure the bearing surface (30) is produced with larger diamond grains (40) and in the second coating procedure the working layer (31) is provided with diamond grains (41) which are smaller than the diamond grains imbedded in the bearing layer (30).

13 Claims, 1 Drawing Sheet

OPEN-END SPINNING ROTOR WITH A COATED FIBER GUIDING SURFACE AND PROCESS FOR ITS MANUFACTURE

BACKGROUND OF THE INVENTION

The present invention relates to a spinning device with a coated fiber guiding surface as well as to a process for its manufacture.

A known method with open-end spinning rotors for example, is to provide them with a nickel-diamond coating because such a coating, in addition to favorable spinning characteristics, has in particular better wear characteristics than e.g. steel (DE 33 39 852 A1). It has been shown, however, that such a nickel-diamond layer does not have a sufficiently long life in particular in the area of the fiber collection groove. For this reason a coating made of iron boride was adopted according to DE 195 09 747. In order to ensure the fiber retention required with spinning rotors, this coating must be structured in the area of the fiber collection groove.

OBJECTS AND SUMMARY OF THE INVENTION

It is a principal object of the present invention to propose a spinning device with a fiber guiding surface coming into contact with fibers which avoids the disadvantages of the state of the art and in which the fiber guiding surface coming into contact with fibers has considerably longer life. In particular, when using the invention in open-end spinning rotors, the resistance to wear of the nickel-diamond coating should be increased especially in the area of the fiber collection groove. Furthermore, a process for the manufacture of an improved spinning device with a fiber guiding surface provided with a nickel-diamond coating is proposed. Additional objects and advantages of the invention will be set forth in part in the following description, or may be obvious from the description, or may be learned through practice of the invention.

The objectives are attained by the invention wherein the nickel-diamond coating of the fiber guiding surface consists of at least an inner bearing layer and an outer working layer, whereby the diamond grains imbedded in the inner bearing layer are larger than the diamond grains imbedded in the outer working layer. The objectives are also obtained through the process for the manufacture of the coated spinning device. Thanks to the outer working layer with fine grain structure, good gliding conditions are achieved for the fibers. In addition, the larger diamond grains ensure in the lower bearing surface that the small diamond grains of the working layer are held securely for a long period of time, so that the life of the nickel-diamond coating is also extended, e.g. in the area of the fiber collection groove of an open end spinning rotor to such a degree that during the entire utilization time of the spinning device, e.g. of a spinning rotor, no additional coating or premature replacement is necessary.

It has been shown that with regard to spinning characteristics in spinning rotors, as well as generally also with regard to the endurance of the coating, good results are obtained if the bearing layer and the working layer are interlaced. This is achieved in that larger diamond grains of the bearing layer as well as grains of the working layer are found next to each other in the transitional area between bearing layer and working layer.

Grain sizes wherein the diamond grains of the bearing layer have a size between 3.5 $\mu$m and 5 $\mu$m and the diamond grains of the working layer have a size between 1 $\mu$m and 2.8 $\mu$m. have proven to be especially advantageous for diamond grains of the bearing layer and the working layer.

Through appropriate selection of the thickness of the two (or more) coatings, the life of the coating can be easily adapted according to the invention to the planned life of the fiber guiding surface.

The ratio of the coating thicknesses is advantageously selected such that the bearing layer is thicker than the working layer since the smaller diamond grains of the working layer are held especially well in this manner. In this case, a selection of the layer thicknesses such that the bearing layer has essentially two times to five times the thickness of the working layer or 5 to 8 times that of the diamond grains (40) which are imbedded in it is advantageous.

According to the process of the invention, the fiber guiding surface undergoes at least two coating procedures whereby a bearing layer with larger diamond grain is produced in a first coating procedure and a working layer with smaller diamond grains than in the bearing layer is produced in a second coating procedure and a lasting coating with good characteristics is achieved. This is especially advantageous with a special variant of the procedure, in a so-called wet-in-wet coating. In this case, the surface to be coated is transferred from the coating bath with one grain size into the coating bath with the other grain size without intermediate treatment of the surface to be coated. A drying process or removal of the residual liquid (of the coating bath) is omitted in this case. Since the coating baths are practically and advantageously identical except for the size of the diamond grains they contain, no soiling takes place. This process is therefore especially economical.

The manufacture of a spinning device, e.g. spinning rotors, according to the invention is simple and results in long life of the fiber guiding surfaces such as, for example, a fiber gliding surface or e.g. the fiber collection groove of open-end spinning rotors, and this without having to sacrifice the gliding ability of fibers and/or fiber retention. On the contrary, the nickel-diamond coating can still be used in spite of greater requirements of wear resistance, whereby an appropriate selection of the thickness of the two layers of the nickel-diamond coating allows for extensive adaptation to different conditions with respect to life and gliding ability and/or fiber retention ability of the fiber guiding surface.

Further details of the invention are explained in detail with the help of drawings.

DETAILED DESCRIPTION

Figure 1:
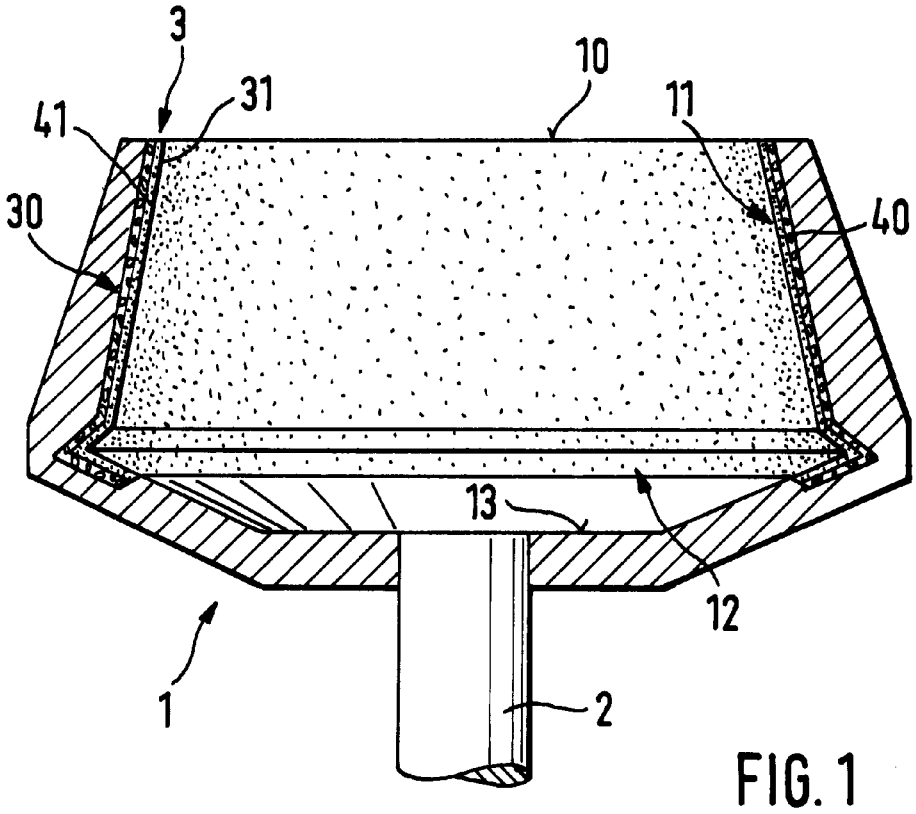
FIG. 1 shows a schematic cross-section of a fiber guiding surface designed according to the invention on the example of a spinning rotor with an inner and outer nickel-diamond coating.

Reference will now be made in detail to the presently preferred embodiments of the invention, one or more examples of which are shown in the drawings. Each example is provided by way of explanation of the invention, and not meant as a limitation of the invention. For example, features illustrated or described as part of one embodiment may be used with another embodiment to yield still a third embodiment. It is intended that the present invention include such modifications and variations.

The spinning rotor 1 shown in FIG. 1, which is lathed in the usual manner from a full piece or formed from sheet metal, is provided with a fiber gliding surface 11 ending in a fiber collection groove 12 following its open edge 10. The interior of the spinning rotor 1 is delimited in a known manner by a bottom 13 on its end away from the open edge 10, by means of which the spinning rotor 1 is mounted on the end of a shaft 2.

During spinning operation, individual fibers are fed in essentially tangential direction to the fiber gliding surface 11 in order to glide along same in a helicoidal path into the fiber collection groove 12 where they are collected in order to be integrated later into the end of a running, drawn-off yarn which is not shown here. Thereby, the fiber gliding surface 11 and the fiber collection groove 12 are put under heavy stress. In order to obtain a long life of this heavily stressed fiber gliding surface 11 and the fiber collection groove 12, these are protected by a nickel-diamond coating 3 which is designed so that it has good characteristics with respect to spinning results on the one hand, but is on the other hand wear resistant and able to resist wear in spite of great stress imposed by the gliding fibers.

Figure 2:
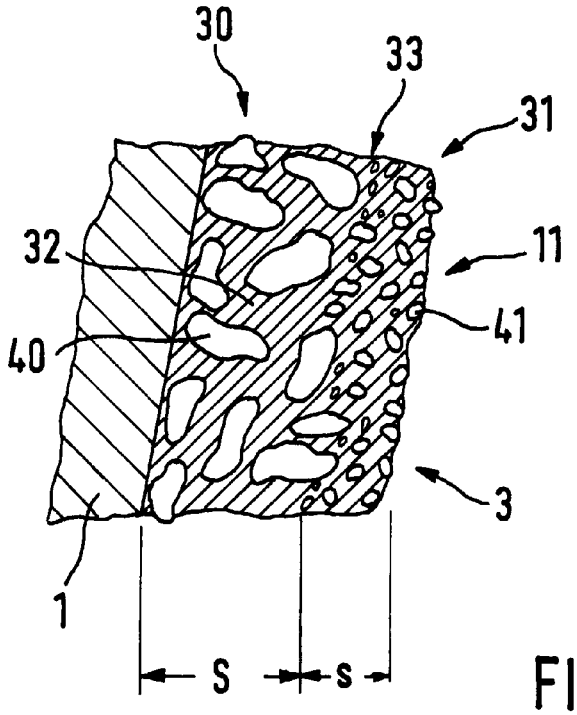
FIG. 2 shows a schematic cross-section of a detail of the spinning rotor shown in FIG. 1.

For this purpose, the spinning rotor 1 to be provided with a nickel-diamond coating 3 is subjected to two or more coating procedures which can be carried out in a conventional manner which is therefore not explained. During the first coating procedure, the spinning rotor 1 receives a bearing surface or inner layer 30 with imbedded diamonds 40 and following this, in a second coating procedure, the spinning rotor 1 receives a second layer, i.e. a working layer or outer layer 31, in which the imbedded diamond grains 41 are smaller than the diamond grains 40 imbedded in the bearing layer 30. In this manner, the coating 3 of the spinning rotor 1 consists of at least two partial layers. These two layers, i.e. the bearing layer 30 and the working layer 31 are—as long as no special smoothing process is provided after the application of the bearing layer 30—not delimited from each other by a clear line, but are practically and to a certain degree interlaced with each other (FIG. 2). Due to the fact that the diamond grains 40 in the lower bearing layer 30 are larger than the diamond grains 41 in the upper covering or working layer 31, the larger diamond grains 40 are anchored over a lower area in the inner bearing layer 30 and are thus effectively secured against being torn out.

The upper, i.e. outer working layer 31 of the coating 3 receives smaller diamond grains 41 which favor the gliding of the fibers along the fiber gliding surface 11 into the fiber collection groove. In the area in which good gliding characteristics are important, these are maintained during the entire life of the spinning rotor 1. But also in the area of the fiber collection groove 12, the coating 3 resists excessive wear because the smaller diamond grains 41 are held securely by the larger diamond grains 40 thanks to the interlacing in the transitional area 33 between the two layers (bearing layer 30 and working layer 31 of the coating 3).

The thickness S of the bearing layer 30 depends to a certain extent on the size of the diamond grains 40 which are imbedded in it, i.e. that it is not less than the size of its imbedded diamond grains 40. The latter have sizes from 3.5 $\mu$m and 5 $\mu$m, preferably starting at approximately 4 $\mu$m, while the smaller diamond grains 41 of the working layer 31 have sizes of 1 $\mu$m to 2.8 $\mu$m, preferably starting at approximately 2 $\mu$m. In the figures the size relationships of the diamond grains 40 and 41 are exaggerated in order to render the size differences more clearly visible.

The device, and also the process, can be varied in many ways within the framework of the present invention, in particular by replacing individual elements by equivalents or through other combinations of different characteristics. Thus, it is not required, for example, that the two layers (bearing layer 30 and working layer 31) have the same thickness. The thickness of the upper layer, the working layer 31, is dimensioned through the appropriate selection of the coating procedure duration so that it has a life which is equal to the projected life of the spinning rotor 1, while the lower layer, the bearing layer 30, is given a thickness S that is such as to securely hold the larger grain diamonds 40. Under certain conditions, the covering or working layer 31 may be thicker than the bearing layer 30.

As stated before, the fiber gliding surface 11 is by far not as much exposed to wear as the fiber collection groove 12 because of the essentially tangential feed of the fibers. Therefore the outer working layer 31, where good gliding characteristics for the supplied fibers is important, need not be very thick but may very well be thinner than the bearing layer 30 which supports it and which has the larger diamond grains 40 (see FIG. 2). By extending the first coating procedure in time beyond the time used for the subsequent coating procedure, this bearing layer 30 is as a rule given a thickness S which is two to five times the thickness s of the covering or working layer 31. The latter has preferably a thickness s which is between 5 $\mu$m and 10 $\mu$m and the bearing layer 30 has a thickness S which is between 20 and 30 $\mu$m, preferably around 25 $\mu$m.

It has been shown that in function of the diamond size selected for the bearing layer 30, a thickness S which is essentially 5 to 8 times that of the diamond grains 40 imbedded in it is advantageous, while a thickness s which is essentially 2 to 6 times that of the diamond grains 41 imbedded in it has proven to be advantageous for the covering or working layer 31. With a grain size of approximately 4 $\mu$m for the diamond grains 40, the thickness S of the bearing layer 30 is therefore 20 to 32 $\mu$m and with a grain size of 2 $\mu$m for the diamond grains 41 in the covering or working layer 31, it has a thickness s between 4 $\mu$m and 12 $\mu$m.

If desired, more than two nickel-diamond coatings can be provided. For example an intermediate layer with medium size diamond grains can constitute the transitional area 33 between the described layers (bearing layer 30 and working layer 31). If necessary, an additional bearing layer (not shown) which need not necessarily be a nickel/diamond layer can be provided between the spinning rotor 1 itself and the bearing layer 30. The nature of the described invention is to be seen in the fact that when the fiber guiding surfaces are coated, they have a lower lying bearing surface 30 which secures the diamond grains 41 of the working layer 31 above.

The invention is explained through the example of a fiber collection surface of a spinning rotor. The invention is however not limited to this, but can also be applied to fiber guiding surfaces, e.g. those of opener rollers of open-end spinning machines. Thus the clothing can in this case be made with a coating according to the invention. A card whose fiber guiding surfaces and clothings can be designed according to the invention, constitutes another spinning device according to the invention. Yet another area of application for the invention are fiber feeding channels of open-end spinning machines.

It should be appreciated by those skilled in the art that various modifications and variations can be made in the present invention without departing from the scope or spirit of the invention. Such variations coming within the scope of the claims and their equivalents are part of the invention.

I claim:

1. A textile fiber spinning device, comprising a fiber guiding surface having a multi-layer nickel-diamond coating that comes into contact with fibers in a spinning process, said multi-layer nickel-diamond coating further comprising at least one inner layer disposed on said fiber guiding surface containing diamond particles imbedded therein of a first size, and an outer layer disposed on said inner layer containing diamond particles imbedded therein of a smaller size than said first size, wherein said outer layer contacts said fibers.

2. The spinning device as in claim 1, further comprising a transitional area between said inner layer and said outer layer, wherein said inner layer and said outer layer interlace.

3. The spinning device as in claim 1, wherein said diamond particles imbedded in said inner layer have a size generally between 3.5 um and 5 um, and said diamond particles imbedded in said outer layer have a size generally between 1 um and 2.8 um.

4. The spinning device as in claim 1, wherein said outer layer and said inner layer comprise different thicknesses.

5. The spinning device as in claim 4, wherein said inner layer has a thickness of generally from 2 to 5 times the thickness of said outer layer.

6. The spinning device as in claim 4, wherein said inner layer has a thickness of generally from 5 to 8 times the size of said diamond particles imbedded therein.

7. The spinning device as in claim 4, said inner layer has a thickness of generally from 20 um to 30 um.

8. The spinning device as in claim 4, wherein said outer layer has a thickness of generally from 2 to 6 times the size of said diamond particles imbedded therein.

9. The spinning device as in claim 4, wherein said outer layer has a thickness of generally from 5 um to 10 um.

10. The spinning device as in claim 1, wherein said inner layer has a thickness of generally from 20 um to 30 um and said outer layer has a thickness of generally from 5 um to 10 um.

11. A process for producing a nickel-diamond coating on a fiber guiding surface of a fiber spinning device, said process comprising subjecting the fiber guiding surface to at least two coating procedures wherein a inner layer with diamond particles is produced atop the fiber guiding surface in a first coating step, and an outer layer with smaller diamond particles, as compared to the diamond particles in the first coating, is produced in a second coating step.

12. The process as in claim 11, wherein the outer layer is disposed directly on the inner layer without intermediate treatment of the inner layer so that the outer layer interlaces with the inner layer.

13. The process as in claim 11, further comprising depositing the inner layer in a thickness greater than that of the outer layer.

* * * * *